US008061441B2

(12) United States Patent
Yasuda

(10) Patent No.: US 8,061,441 B2
(45) Date of Patent: Nov. 22, 2011

(54) AUTONOMOUS EXCAVATING APPARATUS

(75) Inventor: Susumu Yasuda, Tsukuba (JP)

(73) Assignee: Japan Aerospace Exploration Agency, Tokyo (JP)

( * ) Notice: Subject to any disclaimer, the term of this patent is extended or adjusted under 35 U.S.C. 154(b) by 348 days.

(21) Appl. No.: 12/347,965

(22) Filed: Dec. 31, 2008

(65) Prior Publication Data

US 2009/0188137 A1 Jul. 30, 2009

(30) Foreign Application Priority Data

Jan. 30, 2008 (JP) ..... 2008-019060

(51) Int. Cl.
*E21B 7/26* (2006.01)

(52) U.S. Cl. ..... 175/26; 175/19; 175/21; 175/57; 175/94

(58) Field of Classification Search ..... 175/19, 175/21, 26, 94, 57
See application file for complete search history.

(56) References Cited

U.S. PATENT DOCUMENTS 3,375,885 A * 4/1968 Scott et al. ..... 175/26
4,726,711 A * 2/1988 Tian ..... 405/184

OTHER PUBLICATIONS

Noriyuki Mizuno and Kazuya Yoshida, "Development of a Robot Prototype for Excavation and Exploration of the Moon and Planet," Tohoku University, pp. 1-8 (Dec. 15, 2001).
Noriyuki Mizuno, et al., "Development of a Robot Prototype for Excavation and Exploration of the Moon and Planet", The Society of Instrument and Control Engineers, Tohoku Branch, 199th Meeting, Dec. 15, 2001, 12 pages

* cited by examiner

*Primary Examiner* — Giovanna Wright
(74) *Attorney, Agent, or Firm* — Blakely, Sokoloff, Taylor & Zafman LLP.

(57) ABSTRACT

Disclosed is a novel autonomous excavating apparatus capable of solving conventional problems. The autonomous excavating apparatus comprises an apparatus body including a lower body 101 formed in a cylindrical shape and combined with a conical-shaped lower end, and a spiral blade 102 provided on an outer peripheral surface of the lower body 101 in the form of a right-handed screw. The lower body 101 has an internal space provided with a wheel 103 which has a rotary shaft 104 rotatably supported relative to the lower body 101 through bearings 105, 106. A motor 108 is fixed to the lower body 101 at a position above the wheel 103, and an output shaft of the motor is coaxially connected to the rotary shaft 104. Thus, the motor 108 can drivingly rotate the wheel 103 relative to the lower body 101.

8 Claims, 9 Drawing Sheets

AUTONOMOUS EXCAVATING APPARATUS

BACKGROUND OF THE INVENTION

1. Field of the Invention

The present invention relates to an autonomous excavating apparatus for autonomously excavating a surface of the earth or other celestial body.

2. Description of the Background Art

In future unmanned lunar missions, it will be necessary to install a measurement unit, such as a lunar seismometer (i.e., a seismometer for measuring moonquakes), on the lunar surface. The moon has substantially no atmosphere, and undergoes extremes of heat and cold, which is a severe environment for such a measurement unit. On the other hand, the lunar surface is covered with sand-like particles (called "regolith") having a heat-insulating effect. Thus, if the measurement unit is buried at an excavation depth of about 1 m, the external temperature variations can be suppressed to ease the severity of the environment. Therefore, there is a need for a technique of autonomously burying a measurement unit or the like in regolith without human intervention.

Mizuno, et al., Tohoku University, Japan, proposes an excavating apparatus adapted to rotate, by motors, blades provided on an apparatus body to scrape out regolith lying beneath the apparatus body while introducing the scraped soil inside the apparatus body, and discharge the introduced regolith outside the apparatus body by a bucket elevator, while rotating the blades (the following Non-Patent Document 1). According to this article, it is reported that a prototype apparatus sank down by 126 mm in 120 minutes.

FIG. 12 shows the excavating apparatus proposed by Mizuno, et al., wherein the upper figure is a side view thereof, and the lower figure is a bottom view thereof. Two blades 1002*a*, 1002*b* are disposed on respective opposite transverse sides of a space beneath a bottom surface of an apparatus body 1001 having an oval shape in transverse section, and adapted to be driven by respective motors 1003*a*, 1003*b*. The two motors 1003*a*, 1003*b* are rotationally synchronized to prevent interference between the blades 1002*a*, 1002*b*. The two motors are adapted to be rotated in opposite directions so as to cancel out torques thereof to prevent rotation of the apparatus body 1001. According to the rotation of the blades 1002*a*, 1002*b*, regolith is introduced inside the apparatus body 1001 through an inlet opening 1005. Then, the introduced regolith is carried upwardly by a bucket elevator 1004, and discharged outside the apparatus body.

[Non-Patent Document 1] "Development of a Robot Prototype for Excavation and Exploration of the Moon and Planet", 199th Workshop, The Society of Instrument and Control Engineers Tohoku Chapter (Dec. 15, 2001)

However, it is considered that the above excavating apparatus involves the following problems.

(1) Due to the structure employing the bucket elevator to discharge regolith outside the apparatus body, it is unable to excavate regolith to a depth greater than a height dimension of the apparatus body.

(2) Due to the blades arranged to be moved relative to the apparatus body, regolith is likely to block a clearance between the apparatus body and each of the blades to preclude the movement of the blades.

(3) Due to a need for providing a regolith-discharging space (i.e., installation space for the bucket elevator) penetrating through the apparatus body, a loading space for payloads, such as a measurement unit, is narrowed.

(4) It is necessary to provide two mechanisms for the rotation of the blades and the discharge of regolith.

(5) The need for rotating the two blades in opposite directions in order to cancel out torques thereof causes complexity in structure and increase in cost and weight.

(6) Due to incapability to move backwardly within regolith, once starting evacuation, it is unable to redo evacuation.

(7) If an excavated hole is cured, the curved region can avoid exposure to solar light to provide enhanced temperature environment. However, the above excavating apparatus is capable of only excavation in a vertical direction.

SUMMARY OF THE INVENTION

Therefore, the present invention is directed to solving the above problems.

In order to achieve this object, according to a first aspect of the present invention, there is provided an autonomous excavating apparatus which comprises an apparatus body generally having an axisymmetric shape and including a tapered-shaped forward end, a blade provided on an outer peripheral surface of the apparatus body in a spiral manner, a wheel provided in an internal space of the apparatus body and rotatably supported relative to the apparatus body, and a motor fixedly provided in the internal space of the apparatus body to drivingly rotate the wheel, wherein the motor is adapted to be driven in such a manner that rotational speed thereof is changed to rotate the apparatus body based on torque applied to the apparatus body caused by the change of rotational speed of the wheel, whereby the blade excavates the ground to allow the apparatus body to be moved forwardly into the ground.

In a specific embodiment of the present invention, the autonomous excavating apparatus may further comprise at least one swing means adapted to swingingly move a rotary shaft of the wheel in such a manner as to incline the rotary shaft of the wheel relative to a central axis of the apparatus body to variably change a direction of forward movement of the apparatus body.

According to a second aspect of the present invention, there is provided an autonomous excavating apparatus control method of controlling an excavating operation of the autonomous excavating apparatus of the present invention, which comprises controlling the motor to be rotated in one direction and in an opposite direction relative to the one direction, in such a manner that, when the motor is rotated in the one direction, it drivingly rotates the wheel by torque greater than a predetermined threshold torque causing the apparatus body to start rotating, and, when the motor is rotated in the opposite direction, it drivingly rotates the wheel by torque less than the predetermined threshold torque, so as to intermittently perform the excavating operation.

According to a third aspect of the present invention, there is provided an autonomous excavating apparatus control method of controlling an excavating operation of the autonomous excavating apparatus in the specific embodiment of the present invention, which comprises a first step of inclining a rotating shaft of the motor by the swing means, about an axis perpendicular to each of the central axis of the apparatus body, and a reference axis for changing the direction of forward movement of the apparatus body thereabout, a second step of controlling the motor to be rotated in one direction and in an opposite direction relative to the one direction, in such a manner that, when the motor is rotated in the one direction, it drivingly rotates the wheel by torque greater than a predetermined threshold torque causing the apparatus body to start rotating, and, when the motor is rotated in the opposite direction, it drivingly rotates the wheel by torque less than the predetermined threshold torque, and a third step of repeating the first and second steps until changing the direction of forward movement of the apparatus body is completed.

According to a fourth aspect of the present invention, there is provided an autonomous excavating apparatus control method of controlling an excavating operation of the autonomous excavating apparatus in the specific embodiment of the present invention, which comprises a first step of stopping the motor, a second step of inclining a rotating shaft of the motor by the swing means, about an axis perpendicular to each of the central axis of the apparatus body, and a reference axis for changing the direction of forward movement of the apparatus body thereabout, a third step of sufficiently slowly increasing the rotation speed of the motor, a fourth step of reversely inclining the rotating shaft of the motor by the swing means, about the axis perpendicular to each of the central axis of the apparatus body, and the reference axis, a fifth step of, after the rotating shaft is fully inclined, slowly reversing a rotation direction of the motor, and a sixth step of repeating the fourth and fifth steps until changing the direction of forward movement of the apparatus body is completed.

According to a fifth aspect of the present invention, there is provided an autonomous excavating apparatus control method of controlling an excavating operation of the autonomous excavating apparatus in the specific embodiment of the present invention, which comprises a first step of aligning a rotating shaft of the motor approximately with the central axis of the apparatus body, a second step of controlling the rotor to be repeatedly rotated in one direction and in an opposite direction relative to the one direction, in such a manner that, when the motor is rotated in the one direction, it drivingly rotates the wheel by torque greater than a predetermined threshold torque causing the apparatus body to start rotating, and, when the motor is rotated in the opposite direction, it drivingly rotates the wheel by torque less than the predetermined threshold torque, so as to allow a swing axis of the swing means to become approximately perpendicular to a reference axis for changing the direction of forward movement of the apparatus body thereabout, a third step of inclining the rotating shaft of the motor by the swing means, about the swing axis, a fourth step of controlling the rotor to be rotated in one direction and in an opposite direction relative to the one direction, in such a manner that, when the motor is rotated in the one direction, it drivingly rotates the wheel by torque greater than a predetermined threshold torque causing the apparatus body to start rotating, and, when the motor is rotated in the opposite direction, it drivingly rotates the wheel by torque less than the predetermined threshold torque, and a fifth step of repeating the first to fourth steps until changing the direction of forward movement of the apparatus body is completed.

According to a sixth aspect of the present invention, there is provided an autonomous excavating apparatus control method of controlling an excavating operation of the autonomous excavating apparatus in the specific embodiment of the present invention, which comprises a first step of aligning a rotating shaft of the motor approximately with the central axis of the apparatus body, a second step of controlling the rotor to be repeatedly rotated in one direction and in an opposite direction relative to the one direction, in such a manner that, when the motor is rotated in the one direction, it drivingly rotates the wheel by torque greater than a predetermined threshold torque causing the apparatus body to start rotating, and, when the motor is rotated in the opposite direction, it drivingly rotates the wheel by torque less than the predetermined threshold torque, so as to allow a swing axis of the swing means to become approximately perpendicular to a reference axis for changing the direction of forward movement of the apparatus body thereabout, a third step of stopping the motor, a fourth step of inclining the rotating shaft of the motor by the swing means, about the swing axis, a fifth step of sufficiently slowly in creasing the rotation speed of the motor, a sixth step of reversely inclining a rotating shaft of the motor by the swing means, about the axis perpendicular to each of the central axis of the apparatus body, and the reference axis, a seventh step of, after the rotating shaft is fully inclined, slowly reversing a rotation direction of the motor, and an eighth step of repeating the sixth and seventh steps until changing the direction of forward movement of the apparatus body is completed.

According to a seventh aspect of the present invention, there is provided an autonomous exploration system which comprises the autonomous excavating apparatus of the present invention, and a rover for carrying the autonomous excavating apparatus, wherein the rover is adapted to travel a surface of the ground under control from a remote location, to find out an excavation position, and then start an excavation operation.

The autonomous excavating apparatus of the present invention having the above features can solve the problems as described in the "Description of the Background Art".

DESCRIPTION OF THE PREFERRED EMBODIMENTS

With reference to the drawings, the present invention will now be described based on several embodiments thereof.

First Embodiment

Figure 1:
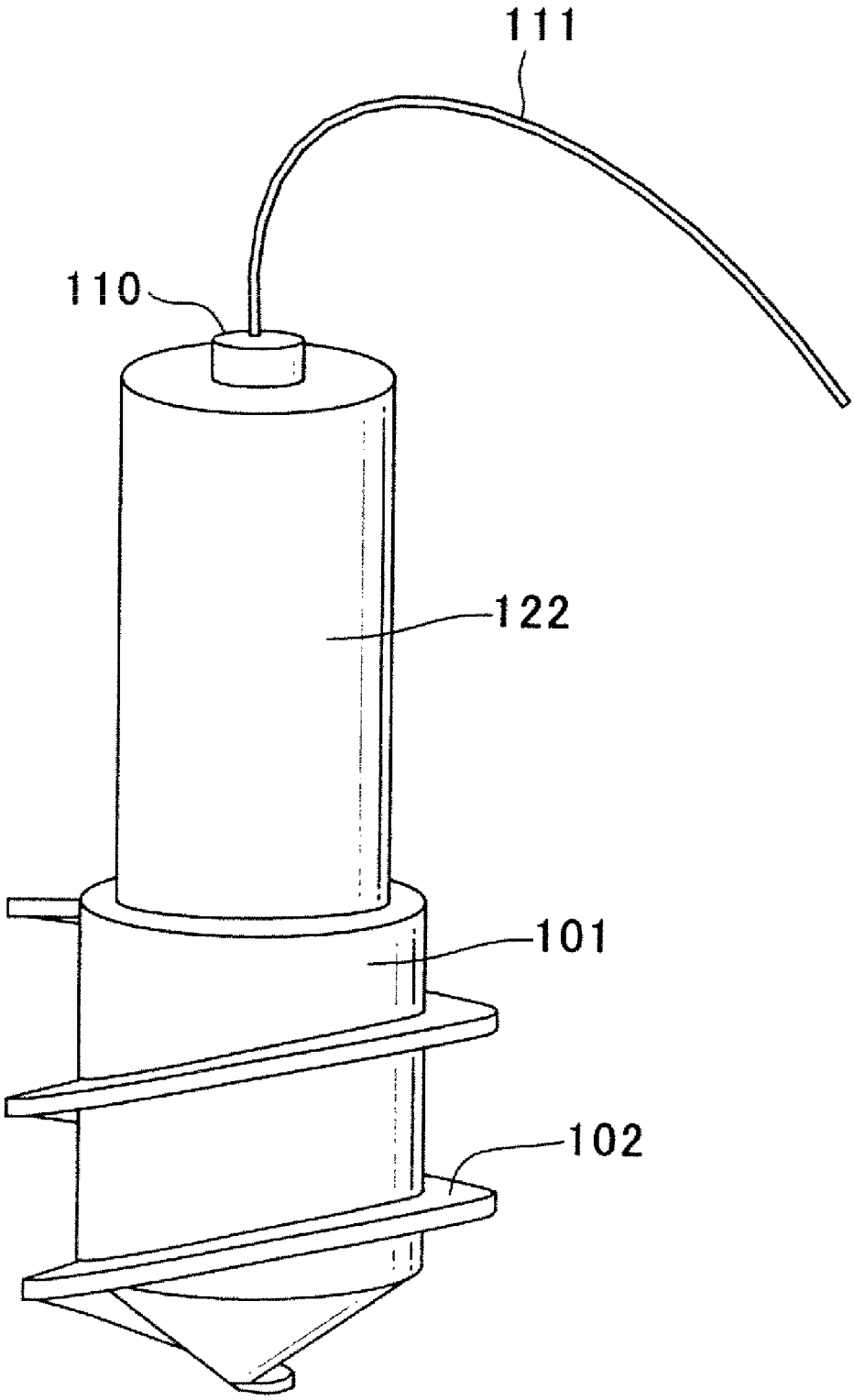
FIG. 1 is a perspective view showing an autonomous excavating apparatus according to a first embodiment of the present invention.
Figure 2:
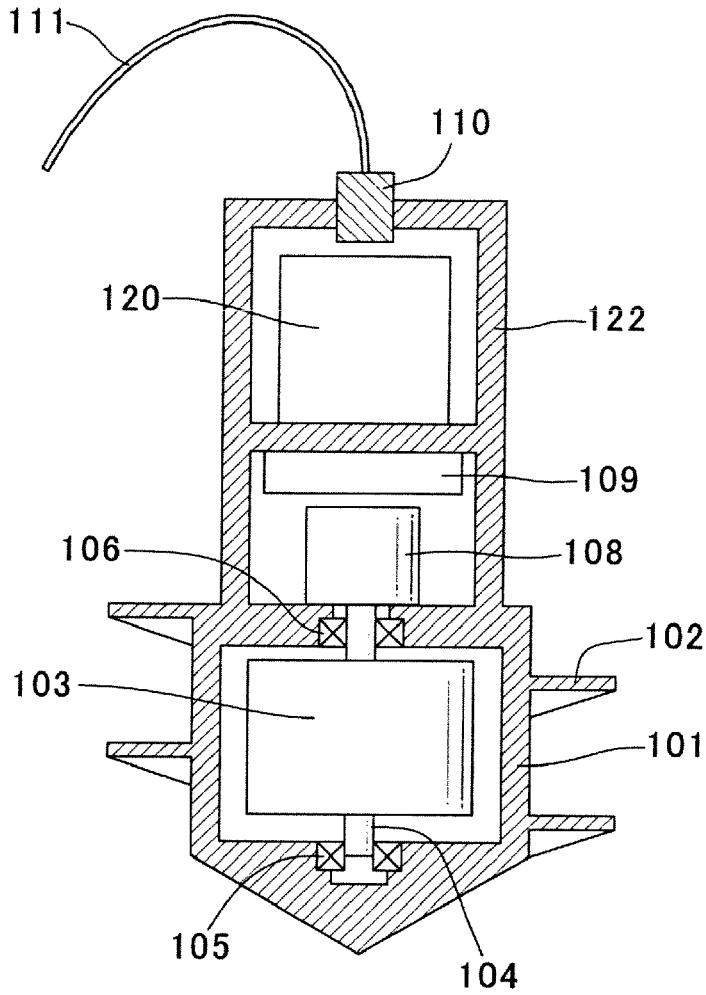
FIG. 2 is a sectional view showing an internal structure of the autonomous excavating apparatus according to the first embodiment.

FIG. 1 is a perspective view showing an autonomous excavating apparatus according to a first embodiment of the present invention, and FIG. 2 is a sectional view showing an internal structure of the autonomous excavating apparatus.

The autonomous excavating apparatus according to the first embodiment comprises an apparatus body including a lower body 101 formed in a cylindrical shape and combined with a conical-shaped lower (forward) end, and a spiral blade 102 provided on an outer peripheral surface of the lower body 101 in the form of a right-handed screw. The apparatus body further includes an upper body 122 formed in a cylindrical shape having a diameter less than that of the lower body 101, and integrally connected to the lower body 101. The upper body 122 has an upper (backward) end mounting thereon a slip ring 110 for preventing twisting of a power-supply communication cable 111 connected to the apparatus body from the outside.

As shown in FIG. 2 the lower body 101 has an internal space provided with a wheel 103 which has a rotary shaft 104 rotatably supported relative to the lower body 101 through lower and upper bearings 105, 106. The upper body 122 has a lower internal space provided with a motor 108 fixed on an upper wall of the lower body 101 located above the wheel 103. The motor has an output shaft (rotating shaft) coaxially connected to the rotary shaft 104. Thus, the motor 108 can drivingly rotate the wheel 103 relative to the lower body 101

The motor 108 is adapted to be driven according to a control signal supplied from a control unit 109, in such a manner as to be rotated in two directions (normal and reverse directions). For example, a DC motor may be used as the motor 108. Further, the motor 1 may be used in combination with a speed reducer, such as a reduction gear mechanism or a harmonic drive mechanism. The blade 102 is arranged in the form of a right-handed screw as mentioned above. That is, the blade 102 is adapted to excavate regolith downwardly (in FIG. 2) when the apparatus body is rotated in a clockwise direction, when viewed downwardly from above the apparatus body in FIG. 2.

The upper body 122 further has an upper inner body provided with an observation sensor 120 for performing an observation within regolith. For example, the observation sensor 120 may include a vibration sensor and a temperature sensor. An electric power for the motor 108 and the observation sensor is supplied from the outside via the power-supply communication cable 111. The power-supply communication cable 111 may also be used for transmitting and receiving a control signal, and/or acquiring information, therethrough.

Figure 3:
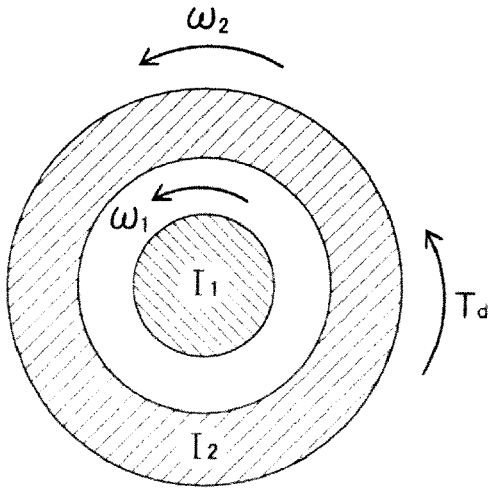
FIG. 3 is a conceptual diagram showing a principle of excavation in the autonomous excavating apparatus according to the first embodiment.

With reference to a conceptual diagram illustrated in FIG. 3, a principle of excavation in the autonomous excavating apparatus according to the first embodiment will be described below. FIG. 3 conceptually shows a cross-section of the lower body 101 in FIG. 2. In FIG. 3, given that an axial moment of inertia of the wheel 103 and any other component rotated together with the wheel 103, and an axial moment of inertia of the lower body 101 and any other component rotated together with the lower body 101, are is $I_1$ and $I_2$, respectively, and an angular velocity of $I_1$ and an angular velocity of $I_2$ are $\omega_1$ and $\omega_2$, respectively. Further, given that torque of the motor 108 is Tm, and an excavation toque to be applied to the apparatus body is Td. In this case, Tm is applied in an opposite direction relative to $I_1$ and $I_2$, and therefore a motion equation is expressed as follows:

$$I_1\acute{\omega}_1=Tm$$

$$I_2\acute{\omega}_2=-Tm+Td$$

Given that a minimum torque required for excavation is Tdmin, $$Tm=Td,\ when\ Td\leqq T_{dmin},\ \text{and}$$

$$I_2\acute{\omega}_2=-Tm+Td,\ \text{when}\ Td>Td\text{min}$$

That is, the apparatus body is not rotated when Td≦Tdmin, and a change in angular velocity occurs when Td>Tdmin. Generally, there is an upper limit of a rotational speed of a motor. Given that this upper limit is ωmax, the angular velocity change is expressed as follows:

$$-\omega\text{max}\leqq\omega_1-\omega_2\leqq\omega\text{max}$$

Figure 4:
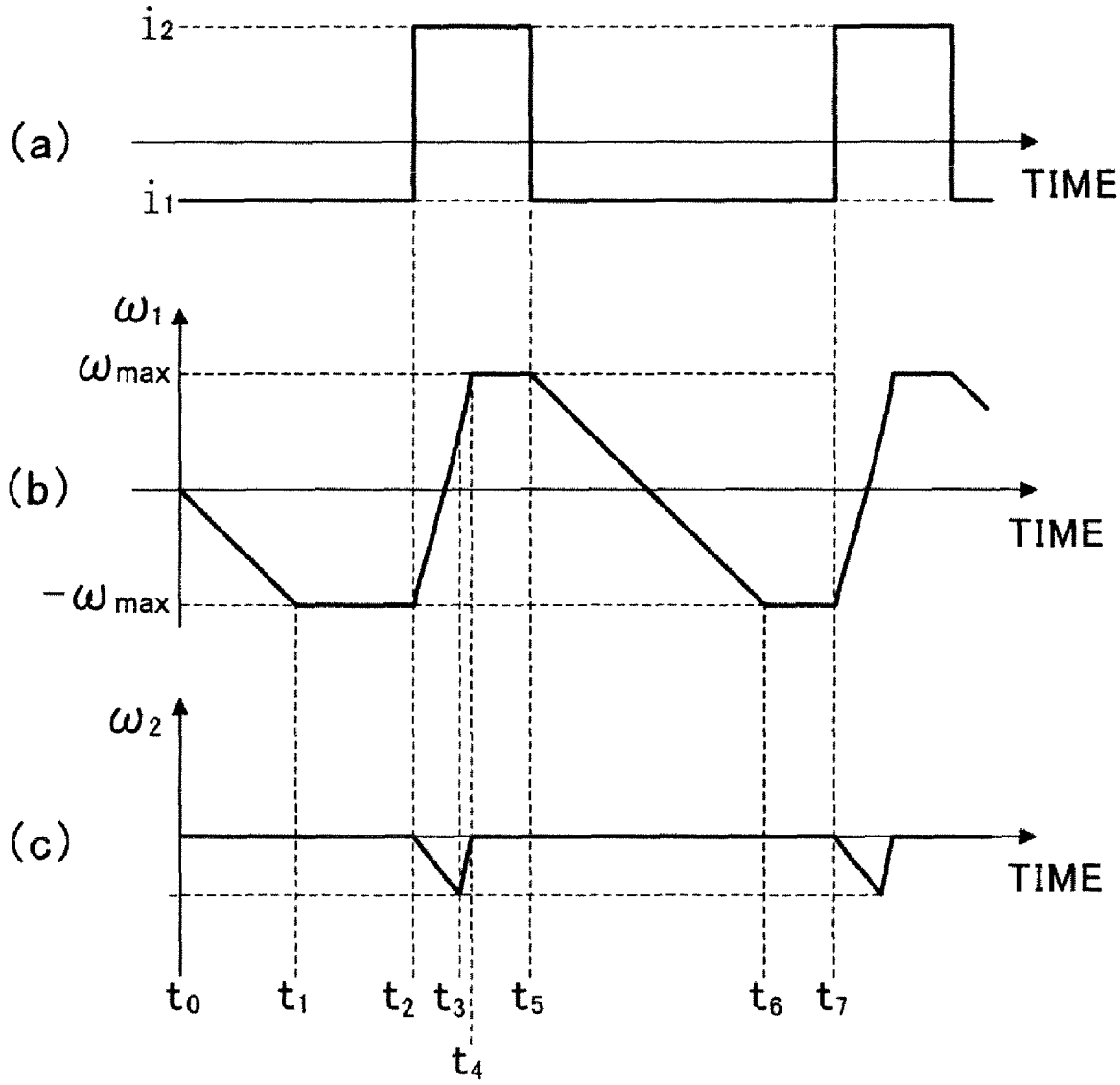
FIGS. 4(*a*) to 4(*c*) are timing charts showing one example of a strategy for performing an autonomous excavation operation in the autonomous excavating apparatus according to the first embodiment.

One example of a strategy for performing an autonomous excavation operation in the autonomous excavating apparatus according to the first embodiment will be described below, with reference timing charts illustrated in FIGS. 4(*a*) to 4(*c*), wherein FIG. 4(*a*), FIG. 4(*b*) and FIG. 4(*c*) show a control signal to be supplied to the motor 108, $\omega_1$, and $\omega_2$, respectively.

At $t=t_0$, each of $\omega_1$ and $\omega_2$ is zero, i.e., each of the motor and the apparatus body is in a stopped state. Given that a current control signal $i_1$ is input at $t=t_0$. The current control signal $i_1$ is set to allow torque of the motor to satisfy the following relation: $|Tm|<|T_{dmin}|$. Thus, $\omega_2$ will be maintained at zero, and only $\omega_1$ will be changed.

When a revolution speed of the motor reaches a lower limit −ωmax (i.e., maximum revolution speed in a reverse direction), $\omega_1$ becomes constant at −ωmax. Then, at $t=t_2$, the current control signal is changed from $i_1$ to $i_2$. Thus, the motor starts rapid deceleration. Then, after the revolution speed transiently becomes zero, the motor starts being rotated in a normal direction, and will be accelerated up to ωmax. The current control signal $i_2$ is set to allow the torque of the motor to satisfy the following relation: $|Tm|>|T_{dmin}|$. Therefore, $\omega_1$ and $\omega_2$ will be changed in opposite directions. Thus, as shown in FIG. 4(*c*), the apparatus body is rotated in an opposite direction relative to the motor during this period.

After $\omega_1-\omega_2$ becomes equal to ωmax at $t=t_3$, the torque of the motor will not be generated. Thus, $\omega_2$ is reduced due to an excavation torque, and $\omega_1$ is increased along with the reduction of $\omega_2$ Then, at $t=t_4$, $\omega_1$ and $\omega_2$ become constant at ωmax and zero, respectively.

At $t=t_5$, the current control signal is set at $i_1$ again. The current control signal $i_1$ is set to allow the torque of the motor to satisfy the following relation: $|Tm|<|T_{dmin}|$, as mentioned above. Thus, the motor's revolution speed in the normal direction will be gradually reduced. Then, after the revolution speed transiently becomes zero, the rotation direction of the motor is changed to the reverse direction, and the motor will be accelerated until $t_6$ when $\omega_1$ becomes equal to −ωmax. During this period, $\omega_2$ will be maintained at zero, and only $\omega_1$ will be changed. When the revolution speed of the motor reaches the lower limit −ωmax, $\omega_1$ becomes constant at −ωmax.

Subsequently, the same sequence will be repeated, so that the apparatus body will be intermittently rotated in one direction. By an action of the blade 102, the apparatus body performs an excavation operation in a downward direction when it is rotated in a clockwise direction, and performs an excavation operation in the backward direction, i.e., moves in an upward direction when it is rotated in a counterclockwise direction.

As described above, in the first embodiment, an excavation operation can be performed by driving the wheel located in the internal space of the apparatus body according to a given sequence. As can be understood from the above description, the autonomous excavating apparatus according to the first embodiment has the following advantages.

(1) The need for discharging excavated regolith by a conveyer can be eliminated. This makes it possible to excavate regolith to a depth greater than a height dimension of the apparatus body.

(2) There is not any component to be moved relative to the apparatus body outside the apparatus body. This makes it possible to eliminate the risk that regolith blocks a clearance between the apparatus body and the external component to preclude a movement of the external component.

(3) Excavated regolith is discharged to the outside through the side of the outer peripheral surface of the apparatus body. This makes it possible to eliminate the need for providing a regolith-discharging space penetrating through the apparatus body (4) The number of required motors can be limited to one. This makes it possible to simplify the structure of the autonomous excavating apparatus (5) There is not the need for designing two rotational mechanisms to cancel out torques thereof.

(6) The apparatus body can be driven in two directions. This makes it possible to move the apparatus body not only in an evacuation (forward) direction but also in the backward direction.

Second Embodiment

Figure 5:
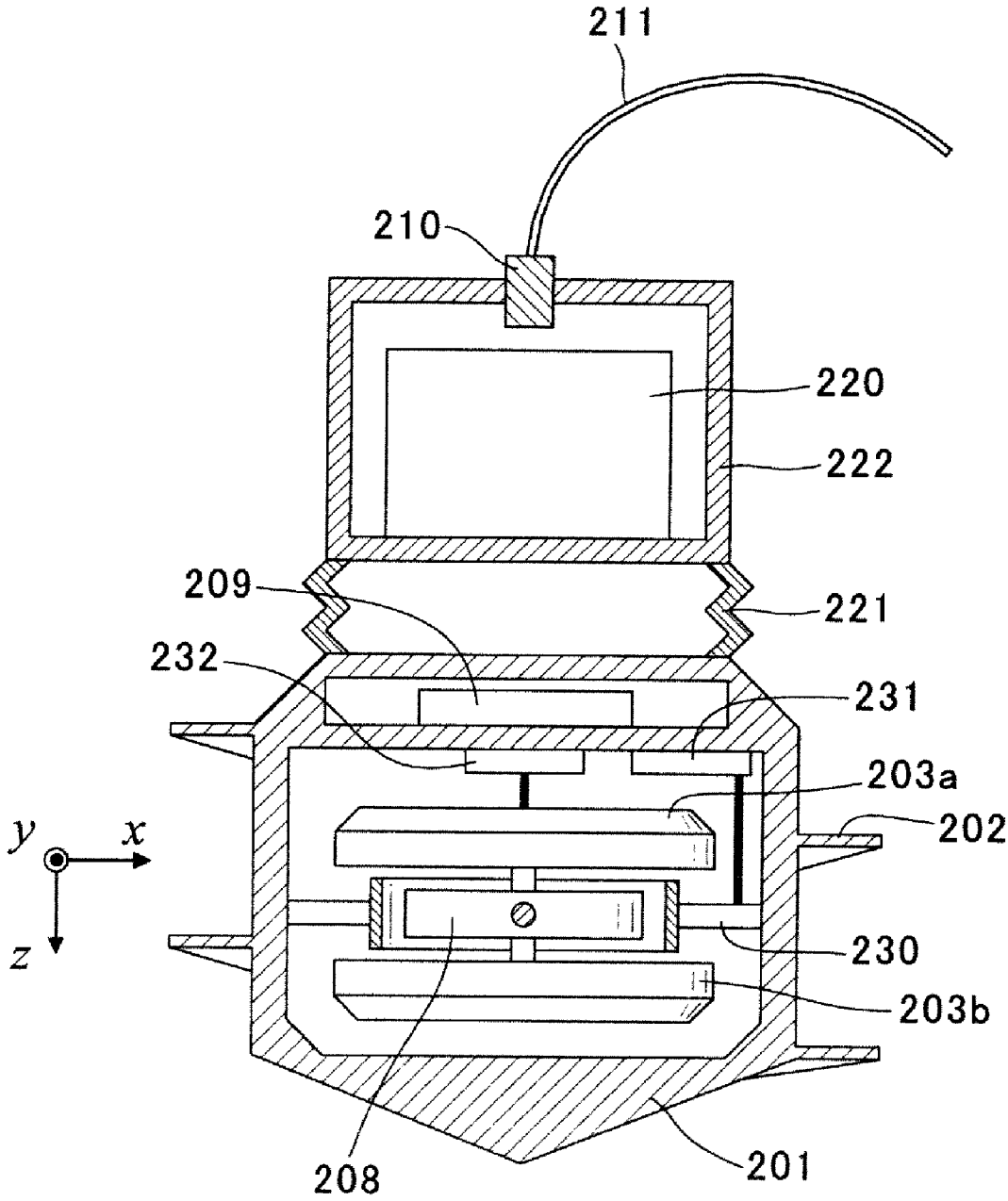
FIG. 5 is a sectional view showing an autonomous excavating apparatus according to a second embodiment of the present invention.

FIG. 5 is a sectional view showing an autonomous excavating apparatus according to a second embodiment of the present invention. The autonomous excavating apparatus according to the second embodiment is designed to allow a direction of forward movement of an apparatus body to be changed within regolith.

As shown in FIG. 5, the autonomous excavating apparatus comprises an apparatus body including a lower body 201 formed in cylindrical shape and combined with a conical-shaped lower (forward) end, and a spiral blade 202 provided on an outer peripheral surface of the lower body 201 in the form of a right-handed screw. The lower body 201 has an upper internal space provided with a control unit 209. An electric power is supplied from the outside to the apparatus body via a power-supply communication cable 211. The power-supply communication cable 211 is also used for perform control and/or acquiring information therethrough. The apparatus body further includes a cylindrical-shaped upper body 222 having an upper (backward) end mounting thereon a slip ring 210 for preventing twisting of the power-supply communication cable 211.

The upper body 222 is elastically connected to an upper wall of the lower body 201 through a bellows mechanism 221. The bellows mechanism 221 allows the upper body 222 to be bent or inclined relative to the lower body 201.

The lower body 201 further has a lower internal space provided with a biaxial gimbal mechanism (swing means) 230, and a motor 208 supported by the biaxial gimbal mechanism 230. The motor 208 has an output shaft (rotating shaft) arranged to protrude from a motor body upwardly and downwardly and connected to two wheels 203*a*, 203*b*. That is, the two wheels 203*a*, 203*b* are attached to the same shaft. The biaxial gimbal mechanism 230 is adapted to be driven about a y-axis and an x-axis (see FIG. 5) by two actuators 231, 232, respectively.

Figure 6:
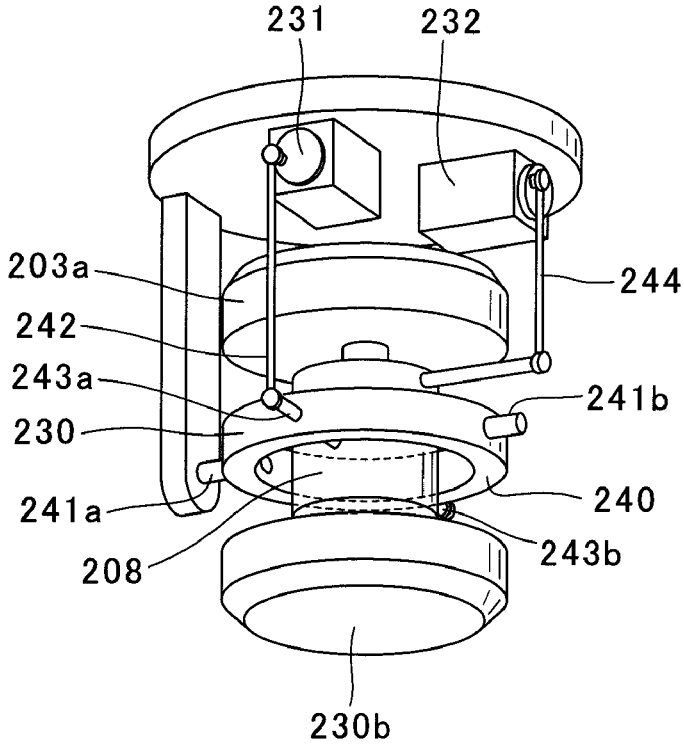
FIG. 6 is a perspective view comprehensibly showing a structure and operation of a biaxial gimbal mechanism in the autonomous excavating apparatus according to the second embodiment.

FIG. 6 is a perspective view comprehensibly showing a structure and operation of the biaxial gimbal mechanism 230. As shown in FIG. 6, a ring 240 is disposed around the motor 208, and supported by two shafts 241*a*, 241*b* aligned with each other in a direction parallel to the y-axis, in a rotatable manner about the shafts 241*a*, 241*b* (in FIG. 6, a bearing for the shaft 241*b* is omitted). The rotation about the shafts 241*a*, 241*b* is driven by the actuator 231 through a rod 242. Further, the motor 208 is attached to two shafts 243*a*, 243*b* aligned with each other in a direction parallel to the x-axis, in a rotatable manner about the shafts 243*a*, 243*b*. The rotation about the shafts 243*a*, 243*b* is driven by the actuator 232 through a rod 244. Thus, each of the actuators 231, 232 can be rotationally driven by a given distance to continuously change an inclination of the motor 208 relative to a central axis of the lower body 201.

When the autonomous excavating apparatus according to the second embodiment is used without inclining the biaxial gimbal mechanism 230, a downward (in FIG. 6) excavation operation and an upward (in FIG. 6) backing operation can be performed in the same manner as that in the first embodiment.

Figure 7:
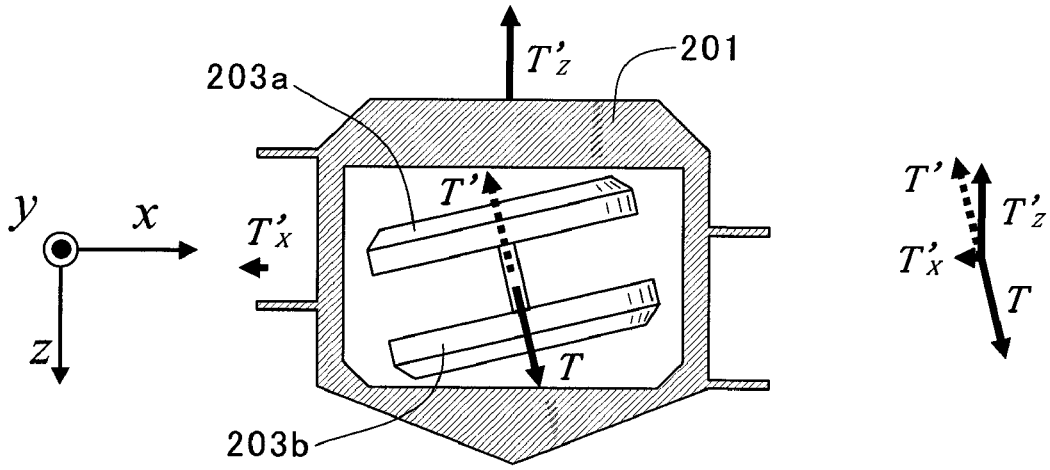
FIG. 7 is a schematic diagram showing a scheme for changing a direction of forward movement of an apparatus body within regolith in the autonomous excavating apparatus according to the second embodiment.

A scheme for changing a direction of forward movement of the apparatus body in the second embodiment will be described below. In the second embodiment, the direction of forward movement of the apparatus body can be changed by two types of schemes. FIG. 7 is an explanatory diagram showing a first one of the schemes.

FIG. 7 shows only the lower body 201 and the wheels 203*a*, 203*b*, for ease of explanation. In FIG. 7, given that a z-axis is a central axis of the apparatus body, and an x-axis is a reference axis for changing the direction of forward movement of the apparatus body thereabout. Based on the biaxial gimbal mechanism 230, the wheels 203*a*, 203*b* are rotated about a y-axis (an axis perpendicular to each of the reference axis and the central axis of the apparatus body) in such a manner as to be inclined relative to the central axis of the apparatus body. In this state, when the motor 208 generates torque T, the wheels 203*a*, 203*b* are accelerated or decelerated. During this period, a reactive torque T' having the same level as that of the torque T and acting in an opposite direction relative to the torque T is applied to the lower body 201 through the biaxial gimbal mechanism 230. The reactive torque T' can be broken down into a z-axis torque Tz' (torque about the z-axis) and an x-axis torque Tx' (torque about the x-axis). That is, when the wheels 203*a*, 203*b* are accelerated within the lower body 201 while being inclined relative to the central axis of the apparatus body, the torque Tz' causing the lower body 201 to be rotated about the central axis of the apparatus body, and the torque Tx' causing the lower body 201 to be inclined relative to the central axis of the apparatus body, are applied to the lower body 201.

In an operation of changing the direction of forward movement of the apparatus body based on the first scheme, the motor 208 may be driven in a state after the biaxial gimbal mechanism 230 is inclined such that the torque Tx' to be applied to the lower body 201 is oriented in a target direction of forward movement to be changed. During the operation of changing the direction of forward movement of the apparatus body based on the first scheme, if the lower body 201 is largely rotated about the central axis of the apparatus body, a direction of torque causing a change in the direction of forward movement of the apparatus body is also be largely changed. This, it is preferable to suppress a rotation angle per cycle about the central axis of the apparatus body to about several to 10 degrees. In the second embodiment, the upper body 222 is elastically connected to the upper (backward) side of the lower body 201. Thus, a direction of forward movement of the lower body 301 can be smoothly changed.

Figure 8:
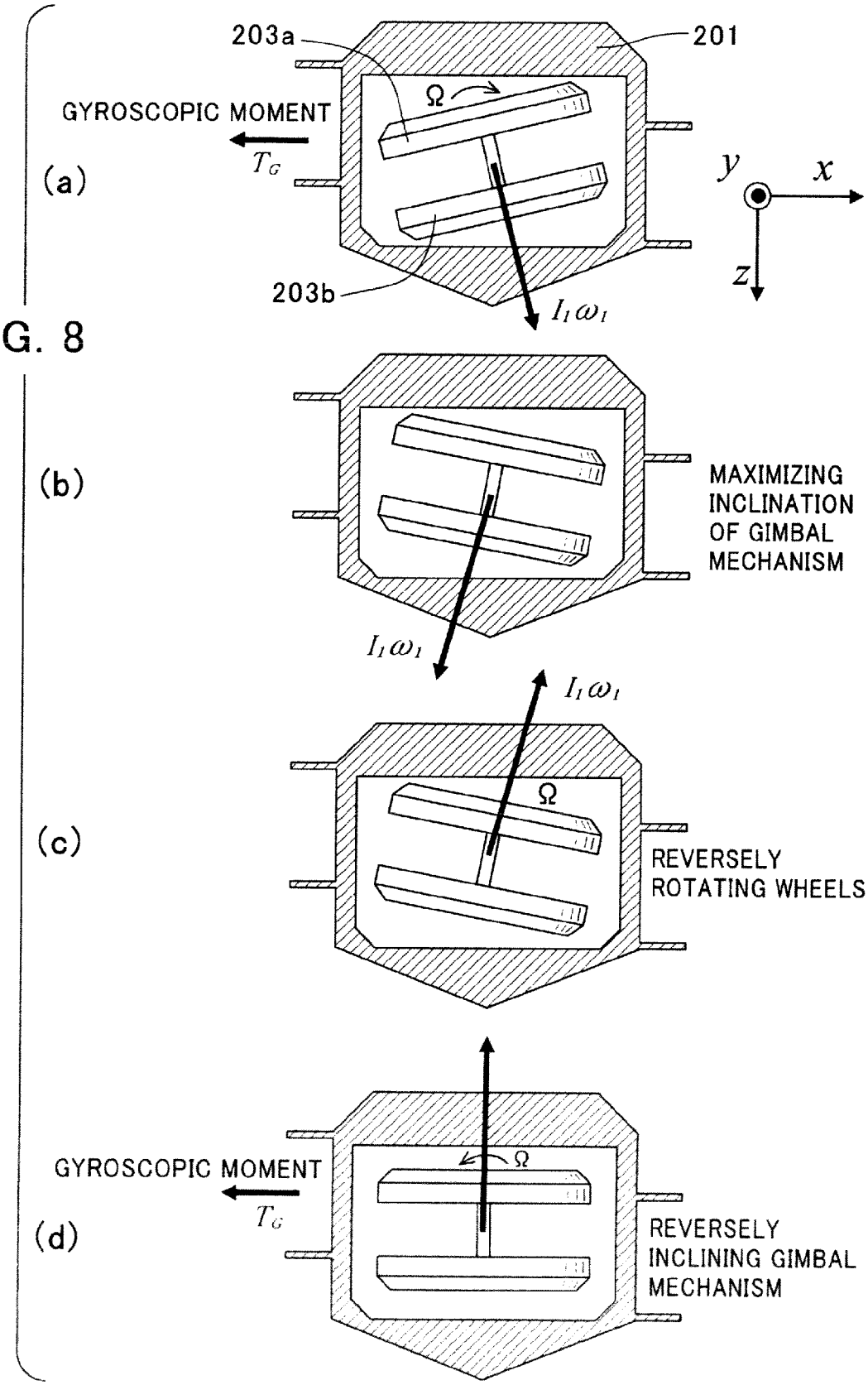
FIGS. 8(*a*) to 8(*d*) are schematic diagrams showing a scheme for changing a direction of forward movement of an apparatus body within regolith in the autonomous excavating apparatus according to the second embodiment.

With reference to FIGS. 8(*a*) to 8(*d*), the second scheme will be described below. FIGS. 8(*a*) to 8(*d*) show only the lower body 201 and the wheels 203*a*, 203*b*, for ease of explanation. In FIGS. 8(*a*) to 8(*d*), given that a z-axis is a central axis of the apparatus body, and an x-axis is a reference axis for changing the direction of forward movement of the apparatus body thereabout, as with FIG. 7. The wheels 203*a*, 203*b* are rotated at an angular velocity $\omega_1$ to have an angular momentum of $I_1 \cdot \omega_1$. In this state, when the biaxial gimbal mechanism 230 is inclined about a y-axis at an angular velocity $\Omega$, a gyroscopic moment $T_G$ ($=I_1 \cdot \omega_1 \cdot \Omega$) is applied to the lower body 201, about the x-axis (see FIG. 8(*a*)). The direction of forward movement of the apparatus body can be changed based on the gyroscopic moment $T_G$.

When the biaxial gimbal mechanism 230 is inclined in one direction, an inclination of the biaxial gimbal mechanism 230 will be finally maximized (see FIG. 8(*b*)). Then, the wheels 203*a*, 203*b* are slowly rotated in a reverse direction while preventing generation of a reaction force causing rotation of the apparatus body (see FIG. 8(*c*)). Then, the biaxial gimbal mechanism 230 is inclined in an opposite direction relative to the one direction, at an angular velocity $\Omega$ (see FIG. 8(*d*)). The wheels 203*a*, 203*b* are being rotated in the reverse direction, and thereby the gyroscopic moment $T_G$ is applied to the lower body 201 in the same direction as that in the previous process. Thus, the direction of forward movement of the apparatus body to be changed can be maintained constant. The above operation can be repeated to intermittently apply torque to the lower body 201 in the same direction.

As described above, in addition to the same advantages as those in the first embodiment, the autonomous excavating apparatus according to the second embodiment has an advantage of being able to change a direction of forward movement of the apparatus body within regolith. In the autonomous excavating apparatus according to the second embodiment, even if either one of the actuators 231, 232 becomes a failed state due to unforeseen circumstances, the direction of forward movement of the apparatus body can be changed based on a sequence in the following third embodiment.

Third Embodiment

Figure 9:
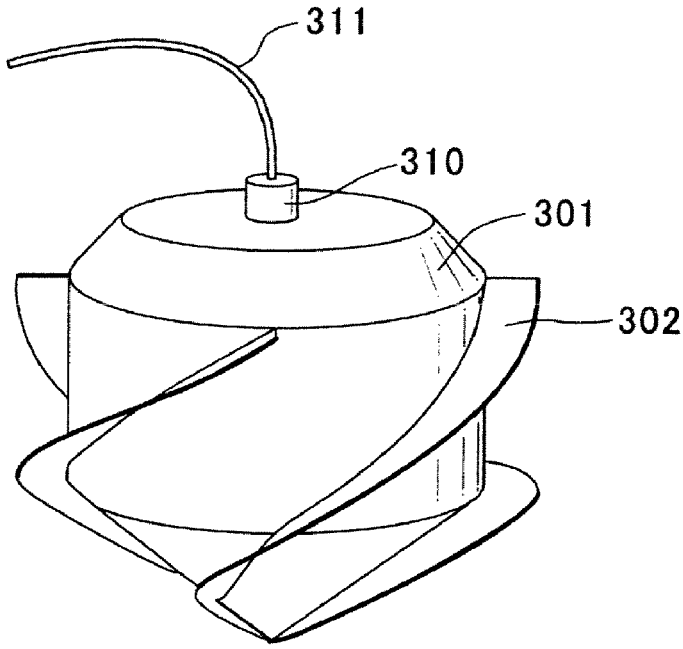
FIG. 9 is a perspective view showing an autonomous excavating apparatus according to a third embodiment of the present invention.
Figure 10:
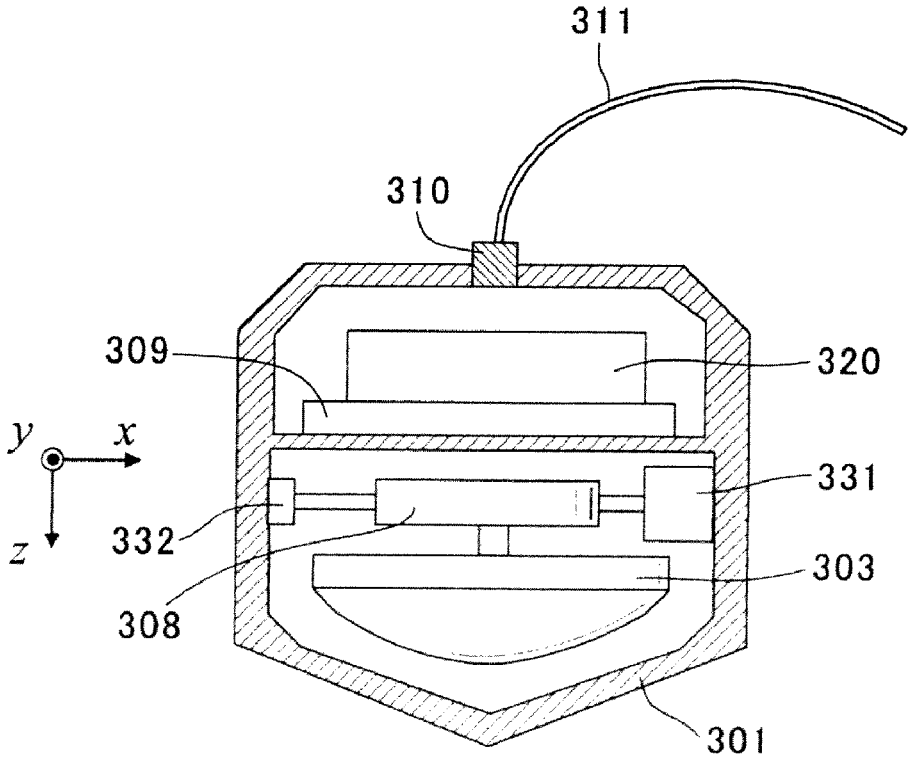
FIG. 10 is a vertical sectional view showing the autonomous excavating apparatus according to the third embodiment.

FIG. 9 is a perspective view showing an autonomous excavating apparatus according to a third embodiment of the present invention, and FIG. 10 is a vertical sectional view showing the autonomous excavating apparatus. The autonomous excavating apparatus comprises an apparatus body 301 formed in cylindrical shape and combined with a pointed conical-shaped lower (forward) end, and four spiral blades 302 each provided on an outer peripheral surface of the apparatus body 301 in the form of a right-handed screw. A slip ring 310 is attached to an upper end of the apparatus body to prevent twisting of a power-supply communication cable 311

As shown in FIG. 10, the apparatus body 301 has a lower internal space provided with a motor 308 supported by an actuator 331 and a bearing 332 (which serve as swing means). The motor 308 has an output shaft (rotating shaft) connected to a wheel 303. The motor 308 is adapted to be swingingly moved about an x-axis in FIG. 10 by the actuator 331. Further, the apparatus body 301 has an upper internal space provided with a control unit 309 and an observation sensor 320 (including a vibration sensor and a temperature sensor). The control unit 309 incorporates an amplifier for driving the motor, an acceleration sensor for sensing attitude, and a gyroscope for detecting an angular velocity. An electric power is supplied from the outside via the power-supply communication cable 311. The power-supply communication cable 311 may also be used for perform control and/or acquiring information therethrough.

The autonomous excavating apparatus according to the third embodiment is different from the autonomous excavating apparatus according to the second embodiment, in that only one actuator 331 is provided, and a direction of the wheel can be changed only by one axis. In addition, the apparatus body in the third embodiment is formed to have a diameter approximately equal to a height dimension. This provides an advantage of being able to reliably prevent turnover, as compared with the first and second embodiments.

In each of the first and second schemes described in connection with the second embodiment, a target torque causing a change in the direction of forward movement of the apparatus body is generated by inclining the biaxial gimbal mechanism 230 about an axis perpendicular to a direction of the target torque. Differently, in the third embodiment, the swing means has low degree of freedom, and thereby it is unable to incline the motor in an arbitrary direction. Thus, in the same manner as that in the first embodiment, the apparatus body is rotated until a shaft (axis) for inclining the motor 308 is oriented in a direction perpendicular to a direction of a target torque causing a change in the direction of forward movement of the apparatus body. During this period, the rotation direction may be a direction causing excavation, i.e., the forward movement of the apparatus body, or may be an opposite (backward) direction relative to the excavation direction. In either direction, a rotation angle of the apparatus body is detected by an angle detection sensor, such as the gyroscope incorporated in the control unit 309, and, after the detected rotation angle shows that the shaft for inclining the motor 308 is oriented in the direction perpendicular to the direction of the target torque, the direction of forward movement of the apparatus body can be changed in the same manner as that in the second embodiment.

As compared with the second embodiment, the autonomous excavating apparatus according to the third embodiment has an advantage of being able to simplify a mechanical structure, although a control sequence becomes complicated.

Fourth Embodiment

Figure 11:
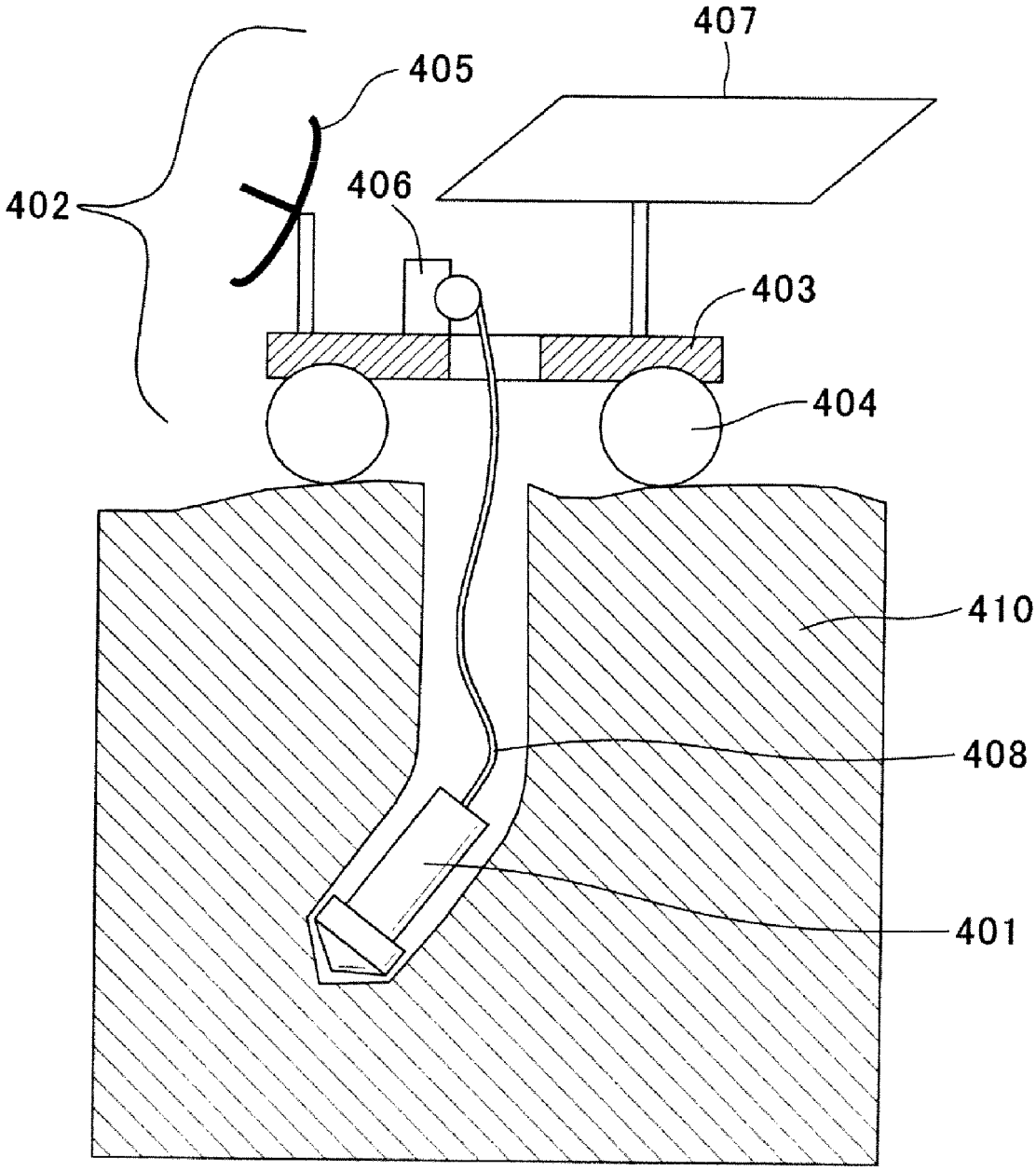
FIG. 11 is a schematic diagram showing an autonomous exploration system according to a fourth embodiment of the present invention.
Figure 12:
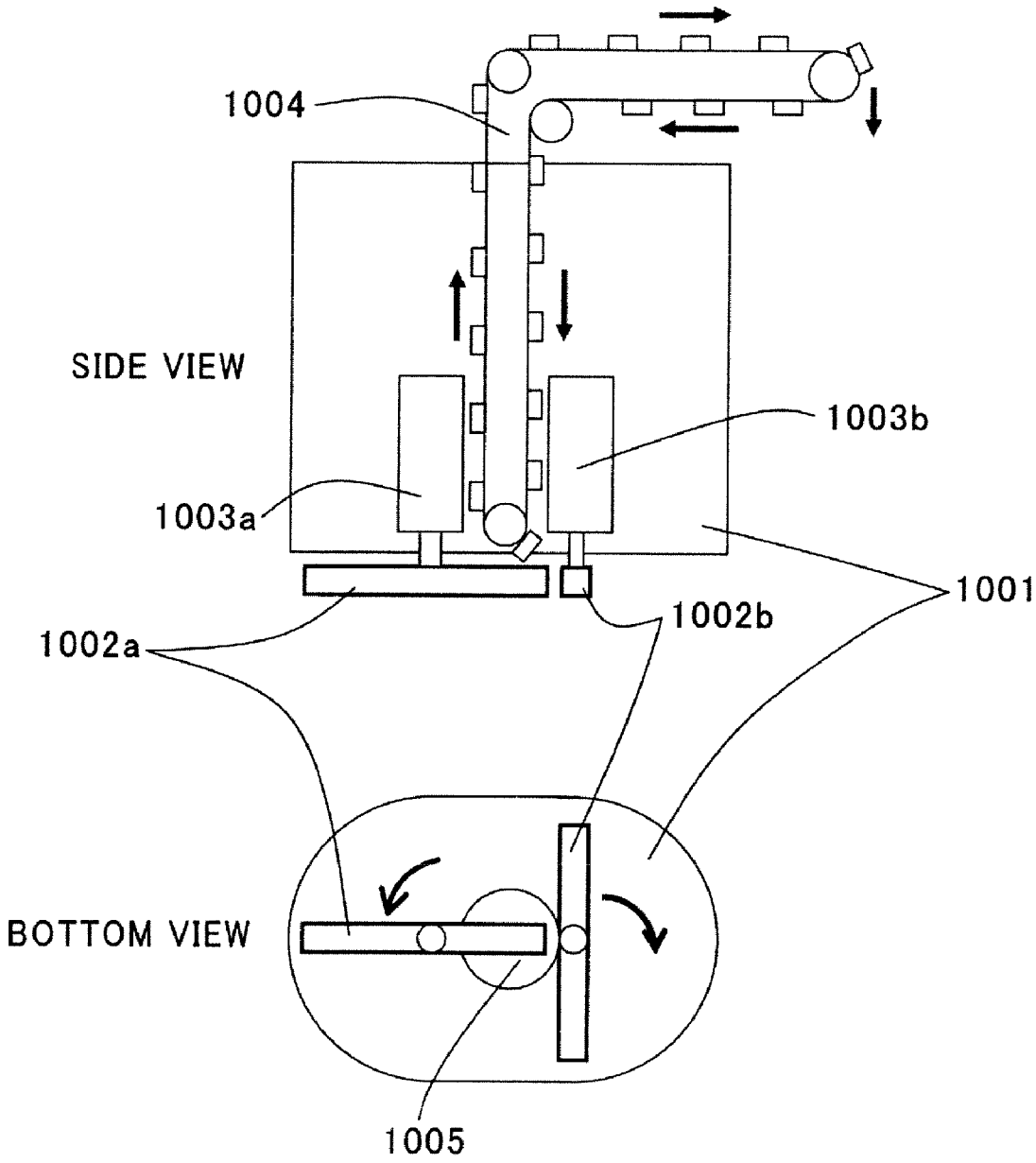
FIG. 12 is a schematic diagram showing a conventional excavating apparatus.

FIG. 11 is a schematic diagram showing an autonomous exploration system comprising an autonomous excavating apparatus, according to a fourth embodiment of the present invention. For example, an autonomous excavating apparatus 401 (may be the autonomous exploration system according to either one of the first to third embodiments) in the fourth embodiment is buried in the lunar surface 410 after excavation. An autonomous rover 403 is adapted to travel along the lunar surface using wheels 404 thereof. A cable feeding mechanism 406 is operable to allow a length of a power-supply communication cable 408 to be maintained at an appropriate value. The autonomous exploration system further includes a solar battery panel 407 for generating a required electric power, and an antenna 405 for communication with the outside.

In the fourth embodiment, the entire system can be carried to a location suitable for excavation by the autonomous rover 403, and then the autonomous excavating apparatus 401 can be moved into regolith to readily bury various sensors mounted on the autonomous excavating apparatus 401 under regolith in an appropriate location.

Although each of the above embodiments has been described based on one example where the apparatus body has a combination of a cylindrical shape and a conical shape, the apparatus body in the present invention may be formed in any other suitable shape, such as a generally conical shape or a so-called "beer keg-like shape", as long as it generally has an axisymmetric shape and include a tapered-shaped forward end.

INDUSTRIAL APPLICABILITY

The autonomous excavating apparatus and the autonomous exploration system of the present invention can be suitably used as means for exploring extraterrestrial celestial bodies, such as the moon, and installing various measurement devices. Further, the autonomous excavating apparatus and the autonomous exploration system of the present invention can be suitably used in transporting/installing a required article in the ground or seabed, in an environment, particularly, desert or sea bottom, causing difficulty in human operations.

What is claimed is:

1. An autonomous excavating apparatus comprising:

an apparatus body generally having an axisymmetric shape and including a tapered-shaped forward end;

a blade provided on an outer peripheral surface of said apparatus body in a spiral manner;

a wheel provided in an internal space of said apparatus body and rotatably supported relative to said apparatus body; and a motor fixedly provided in the internal space of said apparatus body to drivingly rotate said wheel, said motor being adapted to be driven in such a manner that rotational speed thereof is changed to rotate said apparatus body based on torque applied to said apparatus body caused by the change of rotational speed of said wheel, whereby said blade excavates the ground to allow said apparatus body to be moved forwardly into the ground.

2. The autonomous excavating apparatus as defined in claim 1, further comprising at least one swing means adapted to swingingly move a rotary shaft of said wheel in such a manner as to incline said rotary shaft of said wheel relative to a central axis of said apparatus body to variably change a direction of forward movement of said apparatus body.

3. An autonomous excavating apparatus control method of controlling an excavating operation of an autonomous excavating apparatus including an apparatus body generally having an axisymmetric shape and including a tapered-shaped forward end, a blade provided on an outer peripheral surface of said apparatus body in a spiral manner, a wheel provided in an internal space of said apparatus body and rotatably supported relative to said apparatus body, and a motor fixedly provided in the internal space of said apparatus body to drivingly rotate said wheel, said motor being adapted to be driven in such a manner that rotational speed thereof is changed to rotate said apparatus body based on torque applied to said apparatus body caused by the change of rotational speed of said wheel, whereby said blade excavates the ground to allow said apparatus body to be moved forwardly into the ground, the method comprising:

controlling said motor to be rotated in one direction and in an opposite direction relative to said one direction, in such a manner that, when said motor is rotated in said one direction, it drivingly rotates said wheel by torque greater than a predetermined threshold torque causing said apparatus body to start rotating, and, when said motor is rotated in said opposite direction, it drivingly rotates said wheel by torque less than said predetermined threshold torque, so as to intermittently perform said excavating operation.

4. An autonomous excavating apparatus control method of controlling an excavating operation of an autonomous excavating apparatus including an apparatus body generally having an axisymmetric shape and including a tapered-shaped forward end, a blade provided on an outer peripheral surface of said apparatus body in a spiral manner, a wheel provided in an internal space of said apparatus body and rotatably supported relative to said apparatus body, a motor fixedly provided in the internal space of said apparatus body to drivingly rotate said wheel, said motor being adapted to be driven in such a manner that rotational speed thereof is changed to rotate said apparatus body based on torque applied to said apparatus body caused by the change of rotational speed of said wheel, whereby said blade excavates the ground to allow said apparatus body to be moved forwardly into the ground, and at least one swing means adapted to swingingly move a rotary shaft of said wheel in such a manner as to incline said rotary shaft of said wheel relative to a central axis of said apparatus body to variably change a direction of forward movement of said apparatus body, the method comprising:

a first step of inclining a rotating shaft of said motor by said swing means, about an axis perpendicular to each of said central axis of said apparatus body, and a reference axis for changing the direction of forward movement of said apparatus body thereabout;

a second step of controlling said motor to be rotated in one direction and in an opposite direction relative to said one direction, in such a manner that, when said motor is rotated in said one direction, it drivingly rotates said wheel by torque greater than a predetermined threshold torque causing said apparatus body to start rotating, and, when said motor is rotated in said opposite direction, it drivingly rotates said wheel by torque less than said predetermined threshold torque; and a third step of repeating said first and second steps until changing the direction of forward movement of said apparatus body is completed.

5. An autonomous excavating apparatus control method of controlling an excavating operation of an autonomous excavating apparatus including an apparatus body generally having an axisymmetric shape and including a tapered-shaped forward end, a blade provided on an outer peripheral surface of said apparatus body in a spiral manner, a wheel provided in an internal space of said apparatus body and rotatably supported relative to said apparatus body, a motor fixedly provided in the internal space of said apparatus body to drivingly rotate said wheel, said motor being adapted to be driven in such a manner that rotational speed thereof is changed to rotate said apparatus body based on torque applied to said apparatus body caused by the change of rotational speed of said wheel, whereby said blade excavates the ground to allow said apparatus body to be moved forwardly into the ground, and at least one swing means adapted to swingingly move a rotary shaft of said wheel in such a manner as to incline said rotary shaft of said wheel relative to a central axis of said apparatus body to variably change a direction of forward movement of said apparatus body, the method comprising:

a first step of stopping said motor;

a second step of inclining a rotating shaft of said motor by said swing means, about an axis perpendicular to each of said central axis of said apparatus body, and a reference axis for changing the direction of forward movement of said apparatus body thereabout;

a third step of sufficiently slowly increasing the rotation speed of said motor;

a fourth step of reversely inclining said rotating shaft of said motor by said swing means, about said axis perpendicular to each of said central axis of said apparatus body, and said reference axis;

a fifth step of, after said rotating shaft is fully inclined, slowly reversing a rotation direction of said motor; and a sixth step of repeating said fourth and fifth steps until changing the direction of forward movement of said apparatus body is completed.

6. An autonomous excavating apparatus control method of controlling an excavating operation of an autonomous excavating apparatus including an apparatus body generally having an axisymmetric shape and including a tapered-shaped forward end, a blade provided on an outer peripheral surface of said apparatus body in a spiral manner, a wheel provided in an internal space of said apparatus body and rotatably supported relative to said apparatus body, a motor fixedly provided in the internal space of said apparatus body to drivingly rotate said wheel, said motor being adapted to be driven in such a manner that rotational speed thereof is changed to rotate said apparatus body based on torque applied to said apparatus body caused by the change of rotational speed of said wheel, whereby said blade excavates the ground to allow said apparatus body to be moved forwardly into the ground, and at least one swing means adapted to swingingly move a rotary shaft of said wheel in such a manner as to incline said rotary shaft of said wheel relative to a central axis of said apparatus body to variably change a direction of forward movement of said apparatus body, the method comprising:

a first step of aligning a rotating shaft of said motor approximately with said central axis of said apparatus body;

a second step of controlling said rotor to be repeatedly rotated in one direction and in an opposite direction relative to said one direction, in such a manner that, when said motor is rotated in said one direction, it drivingly rotates said wheel by torque greater than a predetermined threshold torque causing said apparatus body to start rotating, and, when said motor is rotated in said opposite direction, it drivingly rotates said wheel by torque less than said predetermined threshold torque, so as to allow a swing axis of said swing means to become approximately perpendicular to a reference axis for changing the direction of forward movement of said apparatus body thereabout;

a third step of inclining said rotating shaft of said motor by said swing means, about said swing axis;

a fourth step of controlling said rotor to be rotated in one direction and in an opposite direction relative to said one direction, in such a manner that, when said motor is rotated in said one direction, it drivingly rotates said wheel by torque greater than a predetermined threshold torque causing said apparatus body to start rotating, and, when said motor is rotated in said opposite direction, it drivingly rotates said wheel by torque less than said predetermined threshold torque; and a fifth step of repeating said first to fourth steps until changing the direction of forward movement of said apparatus body is completed.

7. An autonomous excavating apparatus control method of controlling an excavating operation of an autonomous excavating apparatus including an apparatus body generally having an axisymmetric shape and including a tapered-shaped forward end, a blade provided on an outer peripheral surface of said apparatus body in a spiral manner, a wheel provided in an internal space of said apparatus body and rotatably supported relative to said apparatus body, a motor fixedly provided in the internal space of said apparatus body to drivingly rotate said wheel, said motor being adapted to be driven in such a manner that rotational speed thereof is changed to rotate said apparatus body based on torque applied to said apparatus body caused by the change of rotational speed of said wheel, whereby said blade excavates the ground to allow said apparatus body to be moved forwardly into the ground, and at least one swing means adapted to swingingly move a rotary shaft of said wheel in such a manner as to incline said rotary shaft of said wheel relative to a central axis of said apparatus body to variably change a direction of forward movement of said apparatus body, the method comprising:

a first step of aligning a rotating shaft of said motor approximately with said central axis of said apparatus body;

a second step of controlling said rotor to be repeatedly rotated in one direction and in an opposite direction relative to said one direction, in such a manner that, when said motor is rotated in said one direction, it drivingly rotates said wheel by torque greater than a predetermined threshold torque causing said apparatus body to start rotating, and, when said motor is rotated in said opposite direction, it drivingly rotates said wheel by torque less than said predetermined threshold torque, so as to allow a swing axis of said swing means to become approximately perpendicular to a reference axis for changing the direction of forward movement of said apparatus body thereabout;

a third step of stopping said motor;

a fourth step of inclining said rotating shaft of said motor by said swing means, about said swing axis;

a fifth step of sufficiently slowly increasing the rotation speed of said motor;

a sixth step of reversely inclining said rotating shaft of said motor by said swing means, about said axis perpendicular to each of said central axis of said apparatus body, and said reference axis;

a seventh step of, after said rotating shaft is fully inclined, slowly reversing a rotation direction of said motor; and an eighth step of repeating said sixth and seventh steps until changing the direction of forward movement of said apparatus body is completed.

8. An autonomous exploration system comprising:

an autonomous excavating apparatus including an apparatus body generally having an axisymmetric shape and including a tapered-shaped forward end, a blade provided on an outer peripheral surface of said apparatus body in a spiral manner, a wheel provided in an internal space of said apparatus body and rotatably supported relative to said apparatus body, and a motor fixedly provided in the internal space of said apparatus body to drivingly rotate said wheel, said motor being adapted to be driven in such a manner that rotational speed thereof is changed to rotate said apparatus body based on torque applied to said apparatus body caused by the change of rotational speed of said wheel, whereby said blade excavates the ground to allow said apparatus body to be moved forwardly into the ground; and a rover for carrying said autonomous excavating apparatus, said rover being adapted to travel a surface of the ground under control from a remote location, to find out an excavation position, and then start an excavation operation.

* * * * *